US010384253B2

(12) United States Patent
Sakane et al.

(10) Patent No.: US 10,384,253 B2
(45) Date of Patent: Aug. 20, 2019

(54) SPINNING FORMING DEVICE

(71) Applicant: KAWASAKI JUKOGYO KABUSHIKI KAISHA, Kobe-shi, Hyogo (JP)

(72) Inventors: Yuto Sakane, Kobe (JP); Yoshihide Imamura, Kobe (JP); Kohei Mikami, Akashi (JP); Hayato Iwasaki, Kobe (JP); Hiroshi Kitano, Kobe (JP)

(73) Assignee: KAWASAKI JUKOGYO KABUSHIKI KAISHA, Kobe (JP)

( * ) Notice: Subject to any disclaimer, the term of this patent is extended or adjusted under 35 U.S.C. 154(b) by 0 days.

(21) Appl. No.: 15/108,183

(22) PCT Filed: Dec. 16, 2014

(86) PCT No.: PCT/JP2014/006280
§ 371 (c)(1),
(2) Date: Jun. 24, 2016

(87) PCT Pub. No.: WO2015/098045
PCT Pub. Date: Jul. 2, 2015

(65) Prior Publication Data

US 2016/0325333 A1 Nov. 10, 2016

(30) Foreign Application Priority Data

Dec. 24, 2013 (JP) ..... 2013-265535
Jan. 29, 2014 (JP) ..... 2014-013935

(51) Int. Cl.
*B21D 22/14* (2006.01)
*B21D 37/16* (2006.01)

(52) U.S. Cl.
CPC ..... *B21D 22/14* (2013.01); *B21D 37/16* (2013.01)

(58) Field of Classification Search
CPC ..... B21D 22/14; B21D 37/16
(Continued)

(56) References Cited

U.S. PATENT DOCUMENTS 3,815,395 A 6/1974 Sass
5,687,599 A * 11/1997 Donaldson ..... B21D 26/14 72/56
2015/0202677 A1* 7/2015 Ogishi ..... B21D 22/18 72/19.1

FOREIGN PATENT DOCUMENTS

JP S48-41965 A 6/1973
JP 2-79594 U 6/1990
(Continued)

OTHER PUBLICATIONS

Jan. 27, 2015 Search Report issued in International Patent Application No. PCT/JP2014/006280.
(Continued)

*Primary Examiner* — Teresa M Ekiert
(74) *Attorney, Agent, or Firm* — Oliff PLC

(57) ABSTRACT

A spinning forming device includes: a rotating shaft that rotates a plate to be formed; a processing tool that presses a transform target portion of the plate to transform the plate; and a heater that locally heats the transform target portion by induction heating. The heater includes an electric conducting pipe, and the electric conducting pipe includes a coil portion extending in a circumferential direction of the rotating shaft and having a doubled circular-arc shape facing the plate. A cooling liquid circulates through the electric conducting pipe by a circulating device.

12 Claims, 10 Drawing Sheets

(58) Field of Classification Search
USPC ..... 72/69
See application file for complete search history.

(56) References Cited

FOREIGN PATENT DOCUMENTS

| | | | |
|---|---|---|---|
| JP | 2005-136095 | A | 5/2005 |
| JP | 2006-212705 | A | 8/2006 |
| JP | 2006294396 | A | 10/2006 |
| JP | 2007-294165 | A | 11/2007 |
| JP | 2008-276974 | A | 11/2008 |
| JP | 2011-218427 | A | 11/2011 |
| JP | 2013-161767 | A | 8/2013 |
| WO | 2014/024384 | A1 | 2/2014 |
| WO | 2014/034140 | A1 | 3/2014 |
| WO | 2014/097551 | A1 | 6/2014 |

OTHER PUBLICATIONS

Jun. 28, 2016 International Preliminary Report on Patentability issued in International Patent Application No. PCT/JP2014/006280.
Feb. 6, 2017 Office Action issued in Chinese Patent Application No. 201480070413.5.

* cited by examiner

SPINNING FORMING DEVICE

TECHNICAL FIELD

The present invention relates to a spinning forming device for forming a plate in a desired shape while rotating the plate.

BACKGROUND ART

Conventionally known is a spinning forming device designed to transform a plate by pressing a processing tool against the plate while rotating the plate. For example, PTL 1 discloses a spinning forming device 100 for a titanium alloy as shown in FIG. 13.

The spinning forming device 100 shown in FIG. 13 includes a spatula 120 and a coil 130. The spatula 120 presses a plate W to be formed against a mandrel (shaping die) 110. The coil 130 locally heats a portion (transform target portion) pressed by the spatula 120 by high frequency induction heating. The coil 130 is parallel to the spatula 120 except for a tip end portion thereof. The tip end portion of the coil 130 is bent so as to get close to a tip end portion of the spatula 120. To be specific, the coil 130 performs heating by the tip end portion in a spot manner.

CITATION LIST

Patent Literature

PTL 1: Japanese Laid-Open Patent Application Publication No. 2011-218427

SUMMARY OF INVENTION

Technical Problem

The inventors of the present invention have found that the spinning forming device can obtain excellent formability by continuously performing local heating of the transform target portion of the plate in a rotational direction of the plate. From this point of view, as a heater suitable for the spinning forming device, the inventors of the present invention have developed a heater including a coil portion, the coil portion extending in the rotational direction of the plate and having a doubled circular-arc shape facing the plate.

Because of the length of the coil portion extending in the rotational direction of the plate and having the doubled circular-arc shape, the amount of heat generated in the coil portion by electric conduction is large. In addition, since the coil portion faces the plate, an area of the coil portion which receives heat radiation from the plate is large. Therefore, the coil portion may melt during spinning forming.

An object of the present invention is to provide a spinning forming device capable of preventing a doubled circular-arc coil portion from melting.

Solution to Problem

To solve the above problem, a spinning forming device of the present invention includes: a rotating shaft that rotates a plate to be formed; a processing tool that presses a transform target portion of the plate to transform the plate; a heater that locally heats the transform target portion by induction heating and includes an electric conducting pipe, the electric conducting pipe including a coil portion, the coil portion extending in a circumferential direction of the rotating shaft and having a doubled circular-arc shape facing the plate; and a circulating device that circulates a cooling liquid through the electric conducting pipe.

According to the above configuration, the electric conducting pipe is cooled by the cooling liquid circulating through the electric conducting pipe. Therefore, the coil portion of the electric conducting pipe can be prevented from melting.

The spinning forming device may further include a heat station including a pair of connection boxes electrically connected to the electric conducting pipe and communicating with the electric conducting pipe, wherein the circulating device may supply the cooling liquid to one of the pair of connection boxes and recover the cooling liquid from the other to circulate the cooling liquid through the electric conducting pipe. According to this configuration, both an electric power line and a cooling liquid line are formed by connecting the pair of connection boxes of the heat station with the electric conducting pipe. With this, a simple configuration can be realized.

The heater may be each of: a rear-side heater disposed at an opposite side of the processing tool across the plate; and a front-side heater disposed at a same side as the processing tool relative to the plate. According to this configuration, the plate can be heated from both sides of the plate in a thickness direction, and this can improve the formability.

The heat station may be configured such that: a current flows through the electric conducting pipe of the front-side heater and the electric conducting pipe of the rear-side heater in series; and the cooling liquid flows through the electric conducting pipe of the front-side heater and the electric conducting pipe of the rear-side heater in parallel. According to this configuration, the current flows through the electric conducting pipe of the front-side heater and the electric conducting pipe of the rear-side heater in series. Therefore, a resonance frequency in a resonance circuit including both of the electric conducting pipes can be made low. In the induction heating, the lower the resonance frequency is, the deeper a current penetration depth (depth of eddy current) becomes. Therefore, the plate can be heated uniformly in the thickness direction from the surface to the inside. Further, the cooling liquid flows through the electric conducting pipe of the front-side heater and the electric conducting pipe of the rear-side heater in parallel. Therefore, the cold cooling liquid having a common temperature can be introduced to both the electric conducting pipes. Thus, the electric conducting pipes can be effectively cooled.

For example, the spinning forming device may be configured such that: each of the electric conducting pipe of the front-side heater and the electric conducting pipe of the rear-side heater includes a pair of lead portions extending from the coil portion outward in a radial direction of the rotating shaft; and the heat station includes a front-side first relay box and a front-side second relay box connected to the respective lead portions of the front-side heater, an electrically-conductive first relay pipe through which the front-side first relay box and one of the pair of connection boxes communicate with each other, a rear-side first relay box and a rear-side second relay box connected to the respective lead portions of the rear-side heater, an electrically-conductive second relay pipe through which the rear-side second relay box and the other connection box communicate with each other, an insulating first sub pipe through which the front-side first relay box and the rear-side first relay box communicate with each other, an insulating second sub pipe through which the front-side second relay box and the rear-side second relay box communicate with each other, and an electrically-conductive member through which the front-side second relay box and the rear-side first relay box are electrically connected to each other.

The spinning forming device may be configured such that: the electrically-conductive member is a hollow member in which the cooling liquid flows; and one of the first sub pipe and the second sub pipe includes an upstream tube through which the cooling liquid having flowed through the electric conducting pipe of the front-side heater or the rear-side heater is introduced from the front-side second relay box or the rear-side first relay box to the electrically-conductive member and a downstream tube through which the cooling liquid is introduced from the electrically-conductive member to the rear-side second relay box or the front-side first relay box. According to this configuration, the electrically-conductive member can also be cooled by utilizing the cooling liquid having cooled the electric conducting pipe of the front-side heater or the rear-side heater.

Or, the spinning forming device may further include a cooling pipe extending along the electrically-conductive member while contacting the electrically-conductive member, wherein one of the first sub pipe and the second sub pipe includes an upstream tube through which the cooling liquid having flowed through the electric conducting pipe of the front-side heater or the rear-side heater is introduced from the front-side second relay box or the rear-side first relay box to the cooling pipe and a downstream tube through which the cooling liquid is introduced from the cooling pipe to the rear-side second relay box or the front-side first relay box. According to this configuration, the electrically-conductive member can also be cooled by utilizing the cooling liquid having cooled the electric conducting pipe of the front-side heater or the rear-side heater.

The spinning forming device may further include a receiving jig attached to the rotating shaft and supporting a central portion of the plate. Unlike the mandrel, the receiving jig does not include a forming surface. To be specific, when using the mandrel, the transform target portion of the plate is pressed against the mandrel by the processing tool. On the other hand, when using the receiving jig, the transform target portion of the plate is pressed by the processing tool at a position away from the receiving jig. In other words, a space is secured at a rear side of the plate (i.e., at an opposite side of the processing tool). Therefore, the rear-side heater can be located immediately close to the transform target portion of the plate regardless of the shape of the plate during processing. With this, the transform target portion can be appropriately heated.

The heater may include: a first core covering an inner circular-arc portion of the coil portion from an opposite side of the plate; a second core covering an outer circular-arc portion of the coil portion from the opposite side of the plate; an inner heat shielding layer covering the inner circular-arc portion of the coil portion and the first core; and an outer heat shielding layer covering the outer circular-arc portion of the coil portion and the second core. According to this configuration, heat radiation applied to the coil portion and the cores from the plate can be reduced.

Advantageous Effects of Invention

The present invention can prevent a doubled circular-arc coil portion from melting.

DESCRIPTION OF EMBODIMENTS

Embodiment 1

Figure 1:
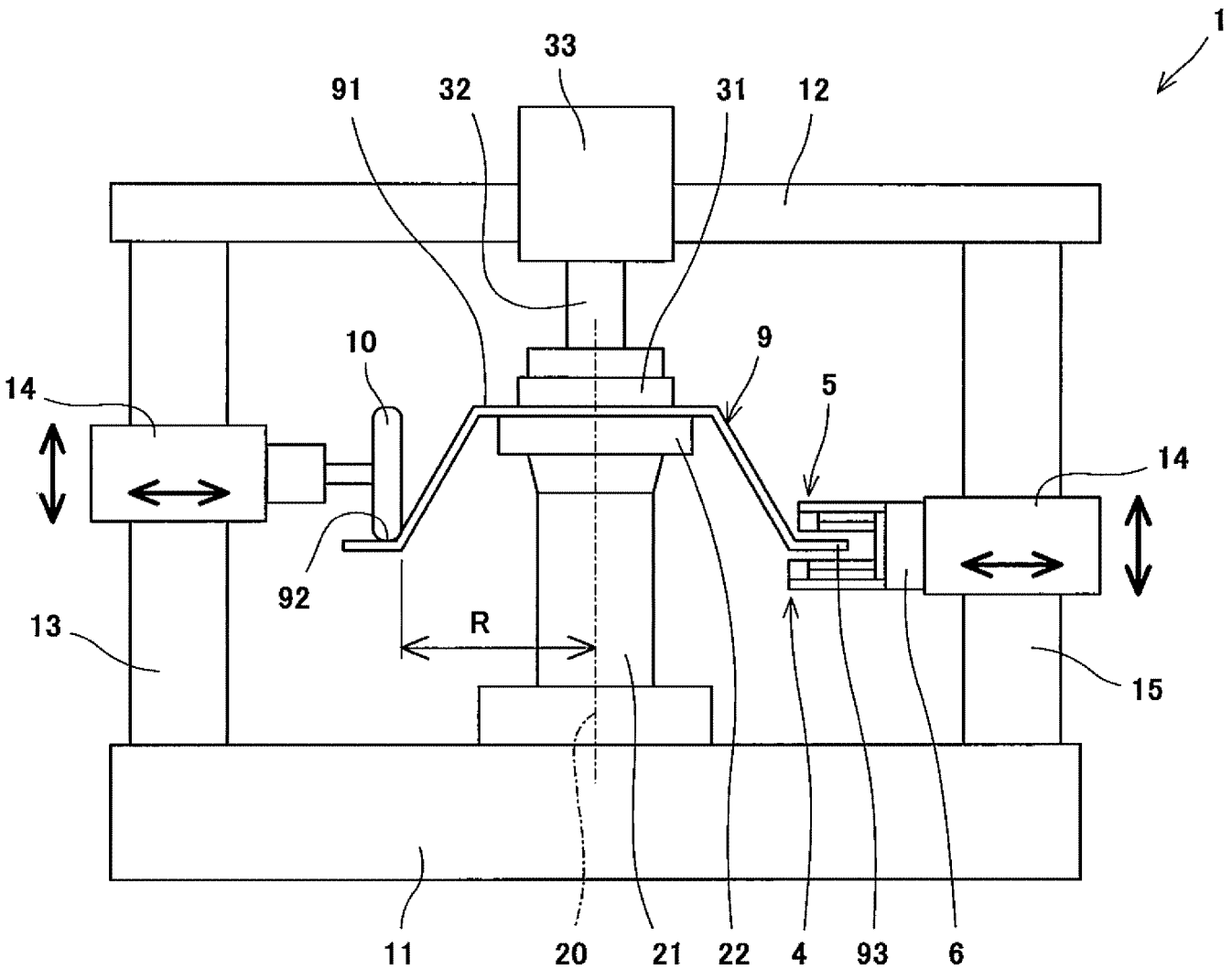
FIG. 1 is a schematic configuration diagram showing a spinning forming device according to Embodiment 1 of the present invention.
Figure 2:
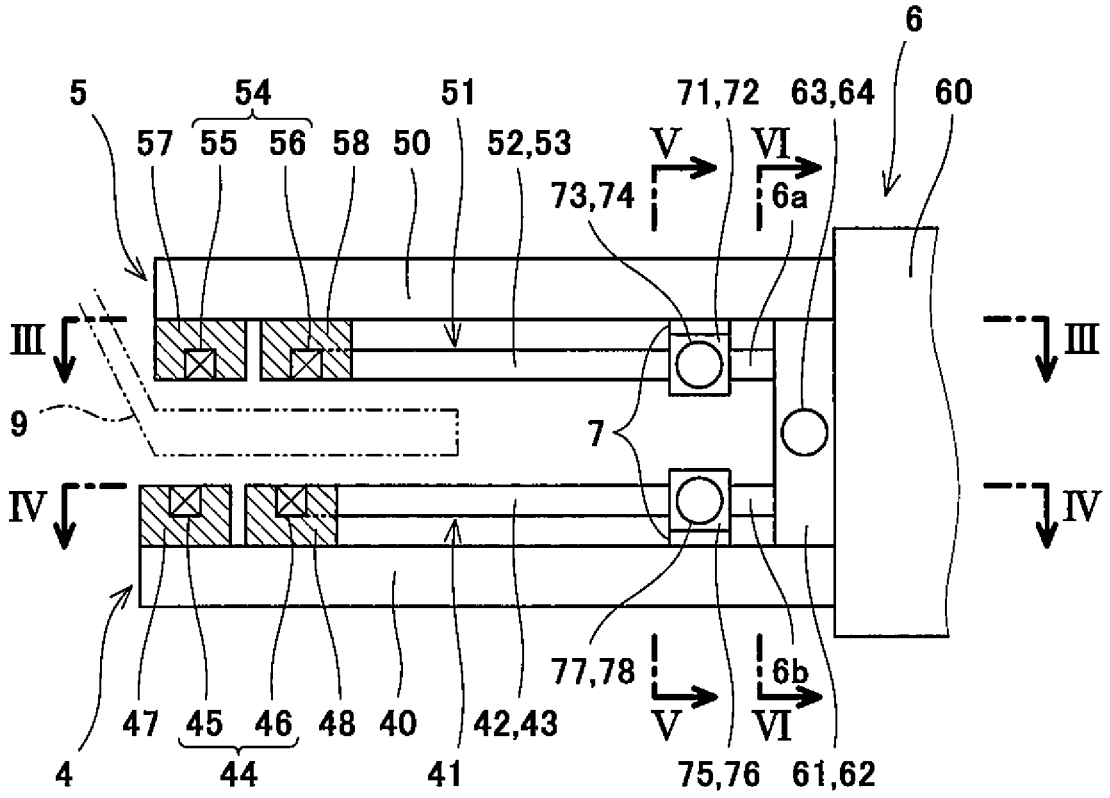
FIG. 2 is a cross-sectional side view showing a front-side heater, a rear-side heater, and a heat station in the spinning forming device shown in FIG. 1.

FIG. 1 shows a spinning forming device 1 according to Embodiment 1 of the present invention. The spinning forming device 1 includes: a rotating shaft 21 that rotates a plate 9 to be formed; a receiving jig 22 interposed between the rotating shaft 21 and the plate 9; and a fixing jig 31. The receiving jig 22 is attached to the rotating shaft 21 and supports a central portion 91 of the plate 9. The fixing jig 31 sandwiches the plate 9 together with the receiving jig 22. The spinning forming device 1 further includes: a front-side heater 5 and a rear-side heater 4 each of which locally heats a transform target portion 92 of the plate 9 by induction heating, the transform target portion 92 being located away from a center axis 20 of the rotating shaft 21 by a predetermined distance R; and a processing tool 10 that presses the transform target portion 92 to transform the plate 9.

An axial direction of the rotating shaft 21 (i.e., a direction in which the center axis 20 extends) is a vertical direction in the present embodiment. However, the axial direction of the rotating shaft 21 may be a horizontal direction or an oblique direction. A lower portion of the rotating shaft 21 is supported by a base 11. A motor (not shown) that rotates the rotating shaft 21 is disposed in the base 11. An upper surface of the rotating shaft 21 is flat, and the receiving jig 22 is fixed to the upper surface of the rotating shaft 21.

The plate 9 is, for example, a flat circular plate. However, the shape of the plate 9 may be a polygonal shape or an oval shape. The plate 9 is not necessarily flat over the entirety. For example, the central portion 91 of the plate 9 may be thicker than a peripheral edge portion 93 of the plate 9, or the entire plate 9 or a part of the plate 9 may be processed in advance to have a tapered shape. A material of the plate 9 is not especially limited and is, for example, a titanium alloy.

The receiving jig 22 has a size within a circle defined by the forming start position of the plate 9. For example, in a case where the receiving jig 22 has a disc shape, a diameter of the receiving jig 22 is equal to or smaller than a diameter of the circle defined by the forming start position of the plate 9. Unlike conventional mandrels, the plate 9 is not transformed by being pressed against a radially outer side surface of the receiving jig 22.

The fixing jig 31 is attached to a pressurizing rod 32. The pressurizing rod 32 is driven by a driving portion 33 in an upward/downward direction to press the plate 9 against the receiving jig 22 via the fixing jig 31. For example, the pressurizing rod 32 and the driving portion 33 constitute a hydraulic cylinder. The driving portion 33 is fixed to a frame 12 disposed above the rotating shaft 21, and a bearing rotatably supporting the pressurizing rod 32 is incorporated in the driving portion 33.

It should be noted that the pressurizing rod 32 and the driving portion 33 are not necessarily required. For example, the fixing jig 31 may be fixed to the receiving jig 22 together with the plate 9 by fastening members, such as bolts or clamps. Or, the fixing jig 31 may be omitted, and the plate 9 may be directly fixed to the receiving jig 22 by, for example, bolts.

In the present embodiment, the processing tool 10 that presses the transform target portion 92 of the plate 9 is disposed above the plate 9, and the plate 9 is processed by the processing tool 10 in a downwardly opening shape that accommodates the receiving jig 22. To be specific, an upper surface of the plate 9 is a front surface, and a lower surface of the plate 9 is a rear surface. However, the processing tool 10 may be disposed under the plate 9, and the plate 9 may be processed by the processing tool 10 in an upwardly opening shape that accommodates the fixing jig 31. To be specific, the lower surface of the plate 9 may be the front surface, and the upper surface of the plate 9 may be the rear surface.

The processing tool 10 is moved by a radial direction movement mechanism 14 in the radial direction of the rotating shaft 21 and is also moved by an axial direction movement mechanism 13 through the radial direction movement mechanism 14 in the axial direction of the rotating shaft 21. The axial direction movement mechanism 13 extends so as to couple the base 11 and the frame 12. In the present embodiment, used as the processing tool 10 is a roller that follows the rotation of the plate 9 to rotate. However, the processing tool 10 is not limited to the roller and may be, for example, a spatula.

The front-side heater 5 is disposed at the same side as the processing tool 10 relative to the plate 9, and the rear-side heater 4 is disposed at an opposite side of the processing tool 10 across the plate 9. In the present embodiment, the front-side heater 5 and the rear-side heater 4 are coupled to a common heat station 6. The front-side heater 5 and the rear-side heater 4 are disposed so as to face each other in the axial direction of the rotating shaft 21. The heat station 6 is disposed outside the heaters 5 and 4 in the radial direction of the rotating shaft 21.

The front-side heater 5 and the rear-side heater 4 are moved by a radial direction movement mechanism 16 through the heat station 6 in the radial direction of the rotating shaft 21 and are also moved by an axial direction movement mechanism 15 through the heat station 6 and the radial direction movement mechanism 16 in the axial direction of the rotating shaft 21. The axial direction movement mechanism 15 extends so as to couple the base 11 and the frame 12.

For example, a displacement meter (not shown) is attached to one of the front-side heater 5 and the rear-side heater 4. The displacement meter measures a distance to the transform target portion 92 of the plate 9. The front-side heater 5 and the rear-side heater 4 are moved in the axial direction and radial direction of the rotating shaft 21 such that a measured value of the displacement meter becomes constant.

The relative positions of the front-side heater 5, the rear-side heater 4, and the processing tool 10 are not especially limited as long as they are located on substantially the same circumference around the center axis 20 of the rotating shaft 21. For example, the front-side heater 5 and the rear-side heater 4 may be separated from the processing tool 10 in a circumferential direction of the rotating shaft 21 by 180°.

Next, configurations of the front-side heater 5, the rear-side heater 4, and the heat station 6 will be explained in detail in reference to FIGS. 2 to 6.

The front-side heater 5 includes: an electric conducting pipe 51 in which a cooling liquid flows; and a supporting plate 50. A cross-sectional shape of the electric conducting pipe 51 is a square shape in the present embodiment but may be any other shape (such as a circular shape). The supporting plate 50 is made of, for example, a heat-resistant material (such as a ceramic fiber-based material) and supports the electric conducting pipe 51 through an insulating member, not shown. The supporting plate 50 is fixed to a below-described main body 60 of the heat station 6 through an insulating member, not shown. It should be noted that the supporting plate 50 may be made of insulating resin. In this case, the supporting plate 50 may directly support the electric conducting pipe 51 and may be directly fixed to the main body 60 of the heat station 6.

The electric conducting pipe 51 includes a coil portion 54 and a pair of lead portions 52 and 53. The coil portion 54 extends in the circumferential direction of the rotating shaft 21 and has a doubled circular-arc shape facing the plate 9. The lead portions 52 and 53 extend from the coil portion 54 outward in the radial direction of the rotating shaft 21. The lead portions 52 and 53 are parallel to each other on a plane (in the present embodiment, a horizontal plane) orthogonal to the center axis 20 of the rotating shaft 21 and extend from substantially a middle of the coil portion 54. To be specific, the coil portion 54 includes one inner circular-arc portion 55 and two outer circular-arc portions 56 spreading at both sides of the lead portions 52 and 53. The inner circular-arc portion 55 and the outer circular-arc portions 56 are spaced apart from each other in the radial direction of the rotating shaft 21. An opening angle (angle between both end portions) of the coil portion 54 is, for example, 60° to 120°.

The electric conducting pipe 51 may be made of any material as long as the material is low in specific resistance and excellent in thermal conductivity. Examples of the material of the electric conducting pipe 51 include pure copper, a copper alloy, brass, and an aluminum alloy.

The front-side heater 5 includes one first core 57 and two second cores 58. The first core 57 covers the inner circular-arc portion 55 of the coil portion 54 from an opposite side of the plate 9. The second cores 58 cover the outer circular-arc portions 56 from the opposite side of the plate 9. The first core 57 is intended to collect magnetic flux generated around the inner circular-arc portion 55, and the second cores 58 are intended to collect magnetic flux generated around the outer circular-arc portions 56. A slight gap is secured between the first core 57 and each of the second cores 58.

Top surfaces (in the present embodiment, lower surfaces) of the first core 57 are flush with one side surface of the inner circular-arc portion 55, the top surfaces being located at both respective sides of the inner circular-arc portion 55, and these surfaces form a flat continuous surface. In other words, the inner circular-arc portion 55 is inserted in a groove of the first core 57 so as to fill the groove. Similarly, top surfaces of each of the second cores 58 are flush with one side surface of the outer circular-arc portion 56, the top surfaces being located at both respective sides of the outer circular-arc portion 56, and these surfaces form a flat continuous surface. In other words, the outer circular-arc portion 56 is inserted into a groove of the second core 58 so as to fill the groove.

The first core 57 and the second cores 58 are supported by the supporting plate 50 through an insulating member, not shown. The first core 57 and the second cores 58 are made of resin in which magnetic metal powder is dispersed. Or, the first core 57 and the second cores 58 may be made of ferrite, silicon steel, or the like.

The rear-side heater 4 includes: an electric conducting pipe 41 in which the cooling liquid flows; and a supporting plate 40. A cross-sectional shape of the electric conducting pipe 41 is a square shape in the present embodiment but may be any other shape (such as a circular shape). The supporting plate 40 is made of, for example, a heat-resistant material (such as a ceramic fiber-based material) and supports the electric conducting pipe 41 through an insulating member, not shown. The supporting plate 40 is fixed to the below-described main body 60 of the heat station 6 through an insulating member, not shown. It should be noted that the supporting plate 40 may be made of insulating resin. In this case, the supporting plate 40 may directly support the electric conducting pipe 41 and may be directly fixed to the main body 60 of the heat station 6.

The electric conducting pipe 41 includes a coil portion 44 and a pair of lead portions 42 and 43. The coil portion 44 extends in the circumferential direction of the rotating shaft 21 and has a doubled circular-arc shape facing the plate 9. The lead portions 42 and 43 extend from the coil portion 44 outward in the radial direction of the rotating shaft 21. The lead portions 42 and 43 are parallel to each other on a plane (in the present embodiment, a horizontal plane) orthogonal to the center axis 20 of the rotating shaft 21 and extend from substantially a middle of the coil portion 44. To be specific, the coil portion 44 includes one inner circular-arc portion 45 and two outer circular-arc portions 46 spreading at both sides of the lead portions 42 and 43. The inner circular-arc portion 45 and the outer circular-arc portions 46 are spaced apart from each other in the radial direction of the rotating shaft 21. An opening angle (angle between both end portions) of the coil portion 44 is, for example, 60° to 120°.

The electric conducting pipe 41 may be made of any material as long as the material is low in specific resistance and excellent in thermal conductivity. Examples of the material of the electric conducting pipe 51 include pure copper, a copper alloy, brass, and an aluminum alloy.

The rear-side heater 4 includes one first core 47 and two second cores 48. The first core 47 covers the inner circular-arc portion 45 of the coil portion 44 from the opposite side of the plate 9. The second cores 48 cover the outer circular-arc portions 46 from the opposite side of the plate 9. The first core 47 is intended to collect magnetic flux generated around the inner circular-arc portion 45, and the second cores 48 are intended to collect magnetic flux generated around the outer circular-arc portions 46. A slight gap is secured between the first core 47 and each of the second cores 48.

Top surfaces (in the present embodiment, upper surfaces) of the first core 47 are flush with one side surface of the inner circular-arc portion 45, the top surfaces being located at both respective sides of the inner circular-arc portion 45, and these surfaces form a flat continuous surface. In other words, the inner circular-arc portion 45 is inserted in a groove of the first core 47 so as to fill the groove. Similarly, top surfaces of each of the second cores 48 are flush with one side surface of the outer circular-arc portion 46, the top surfaces being located at both respective sides of the outer circular-arc portion 46, and these surfaces form a flat continuous surface. In other words, the outer circular-arc portion 46 is inserted into a groove of the second core 48 so as to fill the groove.

The first core 47 and the second cores 48 are supported by the supporting plate 40 through an insulating member, not shown. The first core 47 and the second cores 48 are made of resin in which magnetic metal powder is dispersed. Or, the first core 47 and the second cores 48 may be made of ferrite, silicon steel, or the like.

The heat station 6 to which the front-side heater 5 and the rear-side heater 4 are coupled includes the box-shaped main body 60 and a pair of connection boxes (a first connection box 61 and a second connection box 62) fixed to a side surface of the main body 60, the side surface facing the rotating shaft 21. The heat station 6 further includes four relay boxes (a front-side first relay box 71, a front-side second relay box 72, a rear-side first relay box 75, and a rear-side second relay box 76) disposed in front of the connection boxes 61 and 62.

An AC power supply circuit for applying a voltage to each of the electric conducting pipe 51 of the front-side heater 5 and the electric conducting pipe 41 of the rear-side heater 4 is formed in the main body 60. The first connection box 61 and the second connection box 62 are made of an electrically-conductive material and are located adjacent to each with an insulating plate 65 interposed therebetween. The first connection box 61 and the second connection box 62 are electrically connected to the power supply circuit provided in the main body 60. In the present embodiment, each of the first connection box 61 and the second connection box 62 extends in the vertical direction so as to be a crosslink between the front-side heater 5 and the rear-side heater 4.

The first connection box 61 and the second connection box 62 are electrically connected to each other through the electric conducting pipe 51 of the front-side heater 5 and the electric conducting pipe 41 of the rear-side heater 4. To be specific, an alternating current flows from one of the connection boxes 61 and 62 to the other through the electric conducting pipes 51 and 41. A frequency of the alternating current is not especially limited but is desirably a high frequency of 5 k to 400 kHz. To be specific, the induction heating performed by the front-side heater 5 and the rear-side heater 4 is desirably high frequency induction heating. When the plate 9 is large (such as when a diameter of the plate 9 is about 1 m or when a thickness of the plate 9 is about 30 mm) or when the plate 9 is a non-magnetic body, a current flowing through the electric conducting pipes 51 and 41 is a large current (for example, not less than 3,000 A). When the plate 9 is made of, for example, a titanium alloy, the transform target portion 92 of the plate 9 is heated to about 900° C. by the flow of the large current through the electric conducting pipes 51 and 41.

Figure 6:
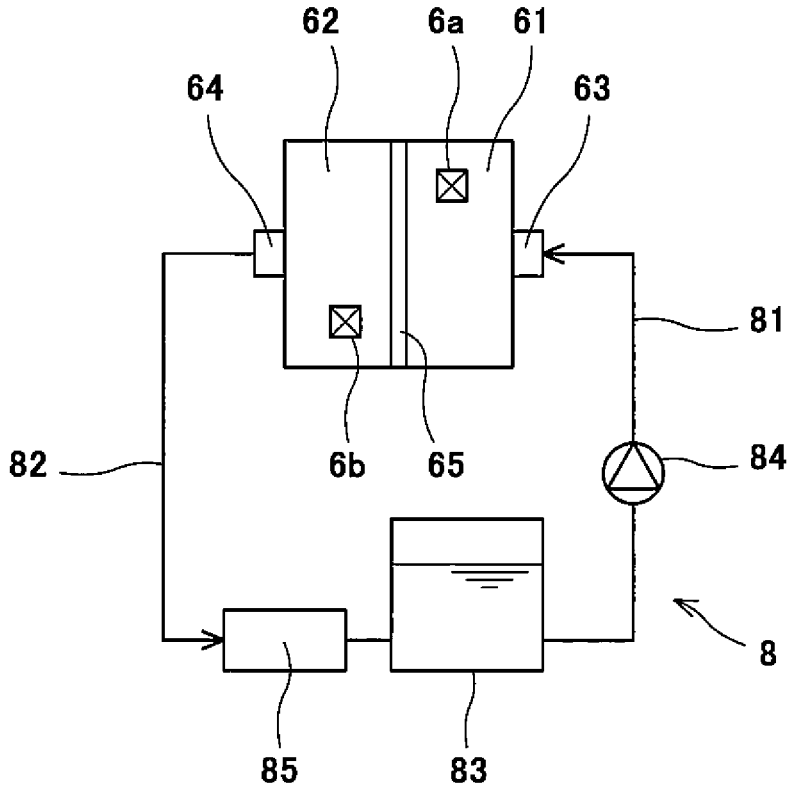
FIG. 6 is a front view showing the heat station when viewed from a position indicated by line VI-VI of FIG. 2.

In the present embodiment, by a circulating device 8 shown in FIG. 6, the cooling liquid is supplied to the first connection box 61, and the cooling liquid is recovered from the second connection box 62. With this, the cooling liquid is circulated through the electric conducting pipe 51 of the front-side heater 5 and the electric conducting pipe 41 of the rear-side heater 4. Specifically, the first connection box 61 is provided with a first port 63, and the second connection box 62 is provided with a second port 64.

The circulating device 8 includes: a tank 83 storing the cooling liquid; a supply pipe 81 connecting the tank 83 with the first port 63 of the first connection box 61; and a recovery pipe 82 connecting the second port 64 of the second connection box 62 with the tank 83. A pump 84 is disposed on the supply pipe 81 and feeds the cooling liquid from the tank 83 to the first connection box 61. A radiator 85 is disposed on the recovery pipe 82 and cools the cooling liquid which has been increased in temperature by the flow through the electric conducting pipes 51 and 41. The radiator 85 may be a heat exchanger that performs heat exchange between the cooling liquid and air or may be a heat exchanger that performs heat exchange between the cooling liquid and any other heat medium. One example of the cooling liquid is water, but any other liquid may be used.

The heat station 6 is configured such that: the current flows through the electric conducting pipe 51 of the front-side heater 5 and the electric conducting pipe 41 of the rear-side heater 4 in series; and the cooling liquid flows through the electric conducting pipe 51 of the front-side heater 5 and the electric conducting pipe 41 of the rear-side heater 4 in parallel. For realizing this configuration, the four relay boxes and a below-described electrically-conductive member 7 are provided.

The front-side first relay box 71, the front-side second relay box 72, the rear-side first relay box 75, and the rear-side second relay box 76 are made of an electrically-conductive material (for example, steel). The relay boxes 71, 72, 75, and 76 are provided with ports 73, 74, 77, and 78, respectively. The front-side first relay box 71 and the front-side second relay box 72 are located in front of the connection boxes 61 and 62 to be lined up in a leftward/rightward direction. The rear-side first relay box 75 and the rear-side second relay box 76 are located immediately under the front-side first relay box 71 and the front-side second relay box 72, respectively.

Figure 3:
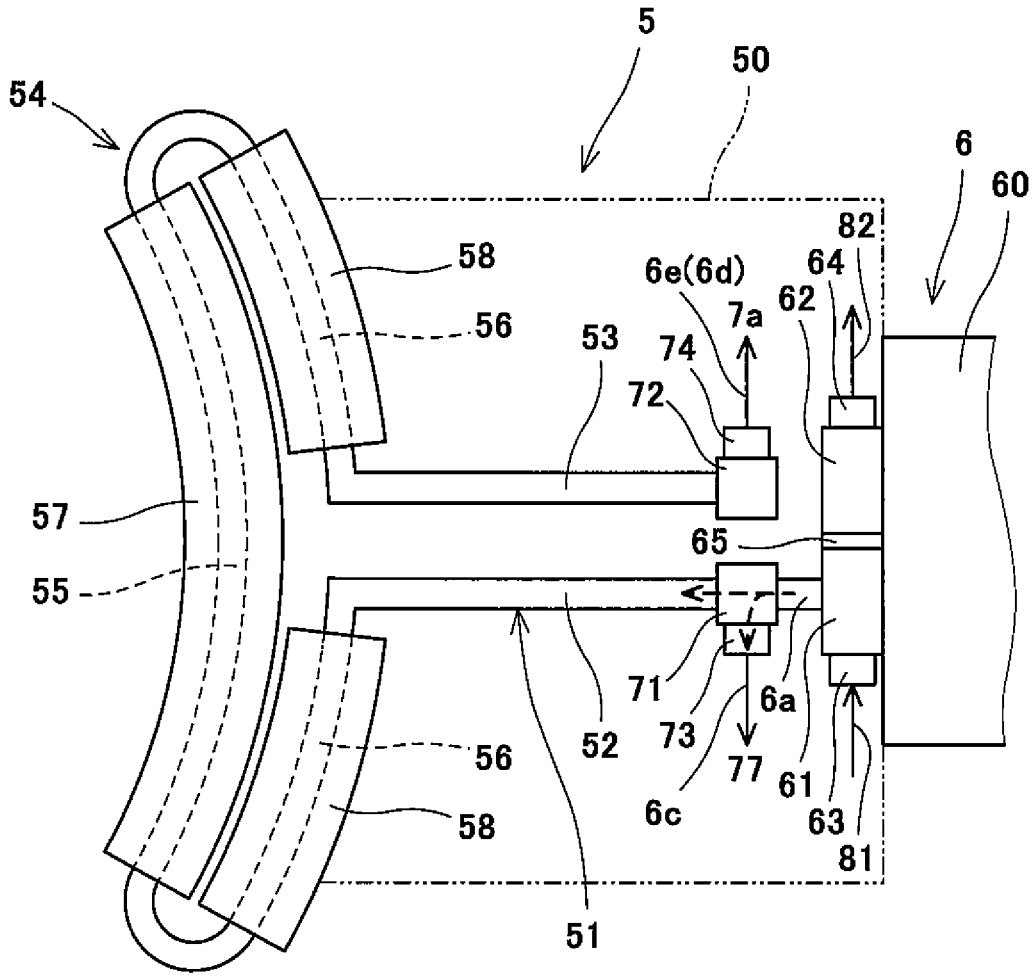
FIG. 3 is a plan view showing the front-side heater and the heat station when viewed from a position indicated by line of FIG. 2.
Figure 4:
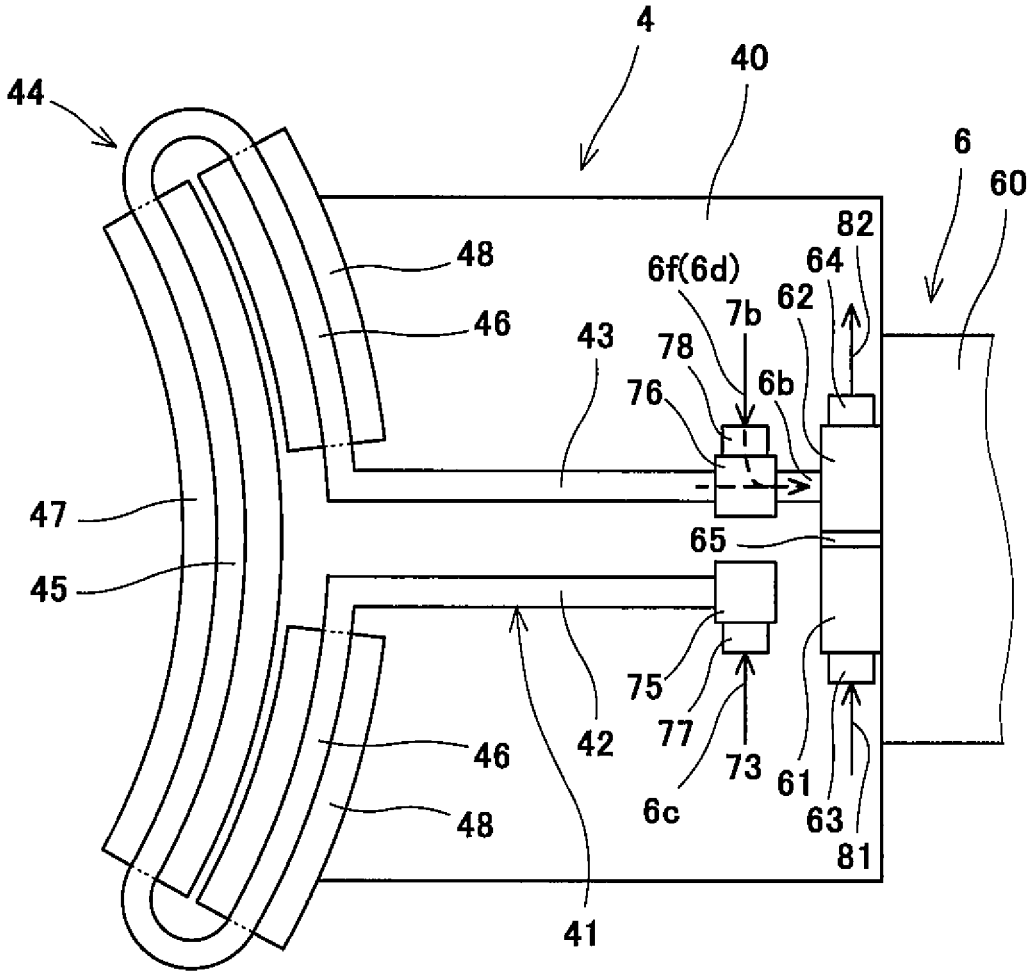
FIG. 4 is a plan view showing the rear-side heater and the heat station when viewed from a position indicated by line IV-IV of FIG. 2.
Figure 5:
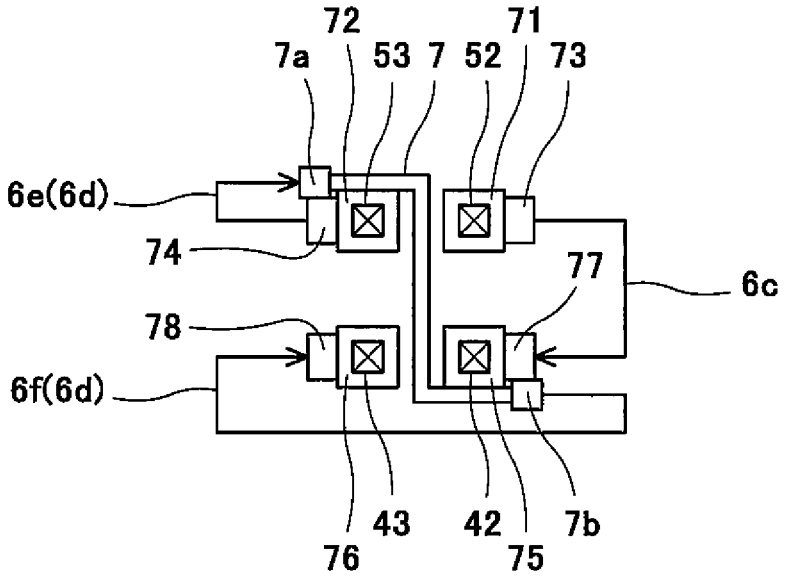
FIG. 5 is a front view showing the heat station when viewed from a position indicated by line V-V of FIG. 2.

The front-side first relay box 71 is connected to the lead portion 52 (located at a left side when viewed in a direction from the heat station 6 toward the rotating shaft 21 in FIG. 3) of the front-side heater 5. The front-side second relay box 72 is connected to the lead portion 53 (located at a right side when viewed in the direction from the heat station 6 toward the rotating shaft 21 in FIG. 3) of the front-side heater 5. The rear-side first relay box 75 is connected to the lead portion 42 (located at a left side when viewed in a direction from the heat station 6 toward the rotating shaft 21 in FIG. 4) of the rear-side heater 4. The rear-side second relay box 76 is connected to the lead portion 43 (located at a right side when viewed in the direction from the heat station 6 toward the rotating shaft 21 in FIG. 4) of the rear-side heater 4.

The front-side first relay box 71 communicates with the first connection box 61 through a first relay pipe 6*a*. The rear-side second relay box 76 communicates with the second connection box 62 through a second relay pipe 6*b*. The first relay pipe 6*a* is made of an electrically-conductive material (for example, a copper pipe) and electrically connects the front-side first relay box 71 with the first connection box 61. The second relay pipe 6*b* is made of an electrically-conductive material (for example, a copper pipe) and electrically connects the rear-side second relay box 76 with the second connection box 62.

The front-side first relay box 71 communicates with the rear-side first relay box 75 through an insulating first sub pipe 6*c*. The front-side second relay box 72 communicates with the rear-side second relay box 76 through an insulating second sub pipe 6*d*. The front-side second relay box 72 is electrically connected to the rear-side first relay box 75 through the electrically-conductive member 7.

In the present embodiment, the first sub pipe 6*c* is constituted by a single tube, and the second sub pipe 6*d* includes an upstream tube 6*e* and a downstream tube 6*f*, which are separated by the electrically-conductive member 7. Herein, the "tube" denotes a hose made of flexible resin.

In the present embodiment, the electrically-conductive member 7 is bent in a crank shape so as to be in surface contact with an upper surface of the front-side second relay box 72 and a lower surface of the rear-side first relay box 75. Therefore, an interval between the coil portion 54 of the front-side heater 5 and the coil portion 44 of the rear-side heater 4 can be changed in such a manner that: the electrically-conductive member 7 is replaced with a member having a height different from the height of the electrically-conductive member 7; or an electrically-conductive spacer is inserted between the electrically-conductive member 7 and at least one of the front-side second relay box 72 and the rear-side first relay box 75.

The electrically-conductive member 7 is a hollow member in which the cooling liquid flows. A first port 7*a* is provided at an end portion of the electrically-conductive member 7, the end portion being located at the front-side second relay box 72 side. A second port 7*b* is provided at an end portion of the electrically-conductive member 7, the end portion being located at the rear-side first relay box 75 side. The first port 7*a* of the electrically-conductive member 7 is connected to the port 74 of the front-side second relay box 72 through the upstream tube 6*e*, and the second port 7*b* is connected to the port 78 of the rear-side second relay box 76 through the downstream tube 6*f*. In order that the cooling liquid flows through the electrically-conductive member 7 in an opposite direction, the upstream tube 6*e* may connect the port 74 of the front-side second relay box 72 with the second port 7*b*, and the downstream tube 6*f* may connect the first port 7*a* with the port 78 of the rear-side second relay box 76.

According to the above configuration, the electric conducting pipe 51 of the front-side heater 5 is electrically connected to and communicates with the first connection box 61 through the front-side first relay box 71 and the first relay pipe 6*a*. Further, the electric conducting pipe 51 is electrically connected to the second connection box 62 through the front-side second relay box 72, the electrically-conductive member 7, the rear-side first relay box 75, the electric conducting pipe 41 of the rear-side heater 4, the rear-side second relay box 76, and the second relay pipe 6*b*. In addition, the electric conducting pipe 51 communicates with the second connection box 62 through the front-side second relay box 72, the upstream tube 6*e*, the electrically-conductive member 7, the downstream tube 6*f*, the rear-side second relay box 76, and the second relay pipe 6*b*.

The electric conducting pipe 41 of the rear-side heater 4 is electrically connected to and communicates with the second connection box 62 through the rear-side second relay box 76 and the second relay pipe 6*b*. Further, the electric conducting pipe 41 is electrically connected to the first connection box 61 through the rear-side first relay box 75, the electrically-conductive member 7, the front-side second relay box 72, the electric conducting pipe 51 of the front-side heater 5, the front-side first relay box 71, and the first relay pipe 6*a*. In addition, the electric conducting pipe 41 communicates with the first connection box 61 through the rear-side first relay box 75, the first sub pipe 6*c*, the front-side first relay box 71, and the first relay pipe 6*a*.

For example, when a current flows from the first connection box 61 to the second connection box 62, the current flows through the first relay pipe 6*a*, the front-side first relay box 71, the electric conducting pipe 51 of the front-side heater 5, the front-side second relay box 72, the electrically-conductive member 7, the rear-side first relay box 75, the electric conducting pipe 41 of the rear-side heater 4, the rear-side second relay box 76, and the second relay pipe 6*b* in this order. To be specific, a flow direction of the current in the electric conducting pipe 51 of the front-side heater 5 and a flow direction of the current in the electric conducting pipe 41 of the rear-side heater 4 are the same as each other.

When the cooling liquid is supplied to the first connection box 61 by the circulating device 8, the cooling liquid is divided by the front-side first connection box 61 into a cooling liquid flowing through the electric conducting pipe 51 of the front-side heater 5 and a cooling liquid flowing through the electric conducting pipe 41 of the rear-side heater 4. The cooling liquid having flowed through the electric conducting pipe 51 of the front-side heater 5 is introduced by the upstream tube 6*e* from the front-side second relay box 72 to the electrically-conductive member 7. The cooling liquid having flowed through the electrically-conductive member 7 is introduced by the downstream tube 6*f* from the electrically-conductive member 7 to the rear-side second relay box 76 and merges with the cooling liquid having flowed through the electric conducting pipe 41 of the rear-side heater 4 at the rear-side second relay box 76. After that, the cooling liquid is recovered from the second connection box 62 by the circulating device 8. As above, a flow direction of the cooling liquid in the electric conducting pipe 51 of the front-side heater 5 and a flow direction of the cooling liquid in the electric conducting pipe 41 of the rear-side heater 4 are the same as each other.

The front-side first relay box 71 is not necessarily a single box and may be constituted by: two divided boxes to which the first relay pipe 6*a* and the lead portion 52 are connected, respectively; and a tube connecting the divided boxes with each other, a T joint being incorporated in the tube. In this case, the two divided boxes are electrically connected to each other by another electrically-conductive member or by metal touch between the divided boxes. This modification is similarly applicable to the rear-side second relay box 75.

By changing electric connections and passage configurations for the cooling liquid, the flow direction of the current and/or the flow direction of the cooling liquid in the front-side heater 5 can be made different from the flow direction of the current and/or the flow direction of the cooling liquid in the rear-side heater 4. Further, the heat station 6 may be configured such that the current flows through the electric conducting pipe 51 of the front-side heater 5 and the electric conducting pipe 41 of the rear-side heater 4 in parallel.

As explained above, in the spinning forming device 1 of the present embodiment, the electric conducting pipes 41 and 51 are cooled by the cooling liquid circulating through the electric conducting pipes 41 and 51 of the heaters 4 and 5. Therefore, the coil portions 44 and 54 of the electric conducting pipes 41 and 51 can be prevented from melting.

Further, in the present embodiment, the current flows through the electric conducting pipe 51 of the front-side heater 5 and the electric conducting pipe 41 of the rear-side heater 4 in series. Therefore, a resonance frequency in a resonance circuit including the electric conducting pipes 41 and 51 can be made low. In the induction heating, the lower the resonance frequency is, the deeper a current penetration depth (depth of eddy current) becomes. Therefore, the plate 9 can be heated uniformly in a thickness direction from the surface to the inside. Further, the cooling liquid flows through the electric conducting pipe 51 of the front-side heater 5 and the electric conducting pipe 41 of the rear-side heater 4 in parallel. Therefore, the cold cooling liquid having a common temperature can be introduced to both the electric conducting pipes 41 and 51. Thus, the electric conducting pipes 41 and 51 can be effectively cooled.

Furthermore, in the present embodiment, the second sub pipe 6*d* includes the upstream tube 6*e* and the downstream tube 6*f*, which are separated by the electrically-conductive member 7. Therefore, the electrically-conductive member 7 can also be cooled by utilizing the cooling liquid having cooled the electric conducting pipe 51 of the front-side heater 5.

Embodiment 2

Figure 7A:
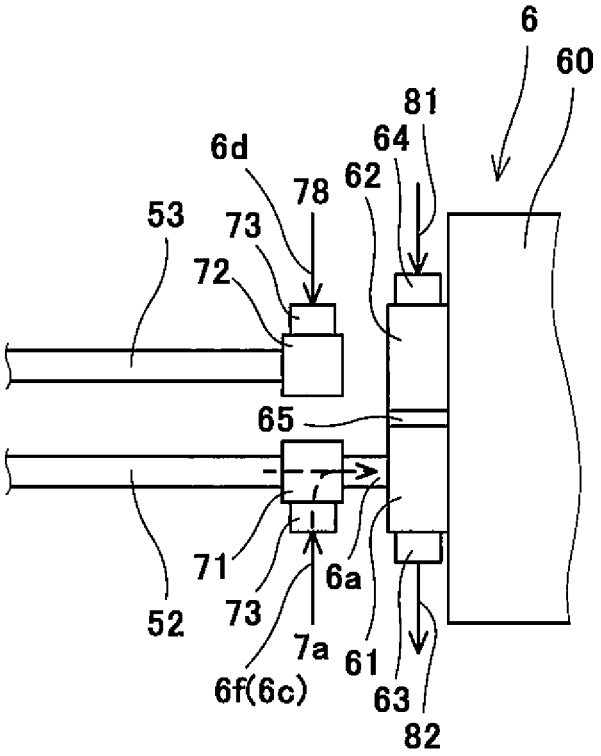
FIG. 7A is a plan view showing a part of the front-side heater and the heat station in the spinning forming device according to Embodiment 2 of the present invention.
Figure 7B:
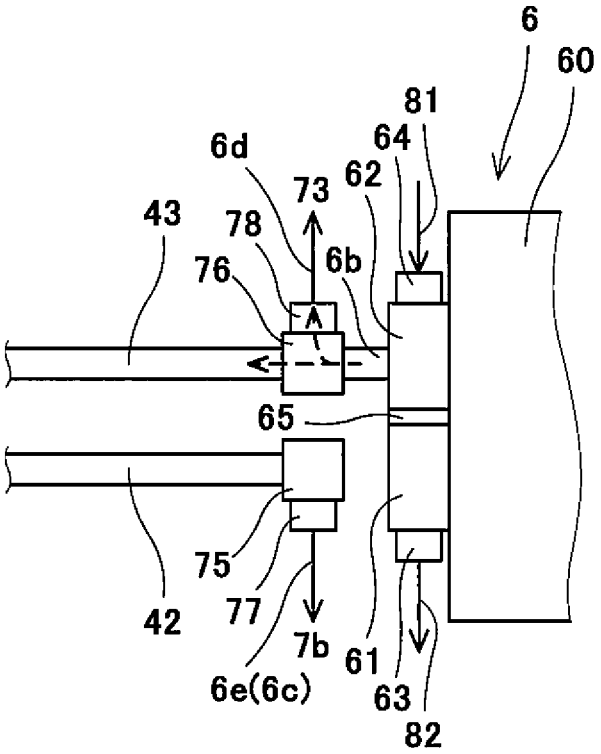
FIG. 7B is a plan view showing a part of the rear-side heater and the heat station in the spinning forming device according to Embodiment 2 of the present invention.
Figure 8:
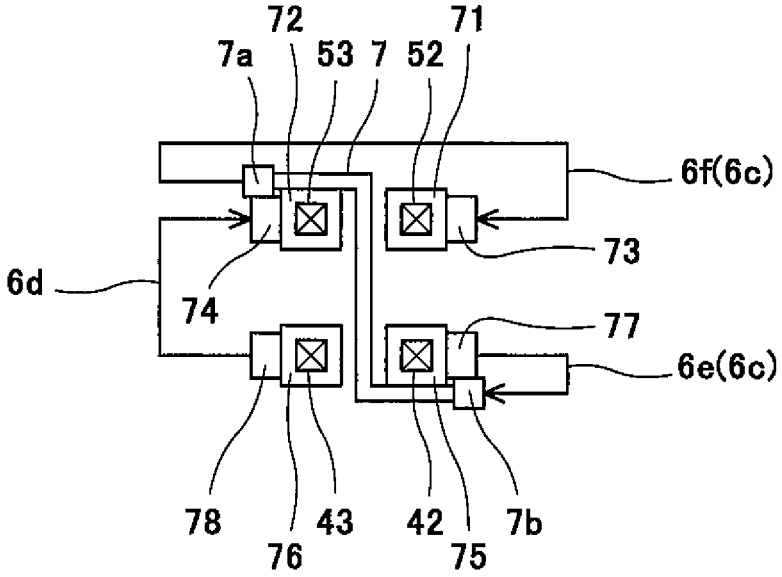
FIG. 8 is a front view showing the heat station in Embodiment 2.

Next, the spinning forming device according to Embodiment 2 of the present invention will be explained in reference to FIGS. 7A, 7B, and 8. In the present embodiment, the same reference signs are used for the same components as in Embodiment 1, and a repetition of the same explanation is avoided.

The spinning forming device of the present embodiment is configured such that the flow direction of the cooling liquid is opposite to the flow direction of the cooling liquid in Embodiment 1. To be specific, the supply pipe 81 is connected to the second port 64 of the second connection box 62, and the recovery pipe 82 is connected to the first port 63 of the first connection box 61. Therefore, the circulating device 8 supplies the cooling liquid to the second connection box 62 and recovers the cooling liquid from the first connection box 61.

Further, in the present embodiment, the cooling liquid having flowed through the electric conducting pipe 41 of the rear-side heater 4 is introduced by the upstream tube 6*e* from the rear-side first relay box 75 to the electrically-conductive member 7, and the cooling liquid having flowed through the electrically-conductive member 7 is introduced by the downstream tube 6*f* from the electrically-conductive member 7 to the front-side first relay box 71. To be specific, the second sub pipe 6*d* through which the second relay boxes 72 and 76 communicate with each other is constituted by a single tube, and the first sub pipe 6*c* through which the first relay boxes 71 and 75 communicate with each other includes the upstream tube 6*e* and the downstream tube 6*f*, which are separated by the electrically-conductive member 7.

The present embodiment can obtain the same effects as Embodiment 1. Further, in the present embodiment, the first sub pipe 6*c* includes the upstream tube 6*e* and the downstream tube 6*f*, which are separated by the electrically-conductive member 7. Therefore, the electrically-conductive member 7 can also be cooled by utilizing the cooling liquid having cooled the electric conducting pipe 41 of the rear-side heater 4.

Other Embodiments

The present invention is not limited to the above embodiments, and various modifications may be made within the scope of the present invention.

For example, although the receiving jig 22 is used in Embodiments 1 and 2, a mandrel may be adopted instead of the receiving jig 22. However, when using the mandrel, the transform target portion of the plate is pressed against the mandrel by the processing tool. On the other hand, when using the receiving jig 22, the transform target portion 92 of the plate 9 is pressed by the processing tool 10 at a position away from the receiving jig 22. In other words, a space is secured at a rear side of the plate 9 (i.e., at an opposite side of the processing tool 10). Therefore, the rear-side heater 4 can be located immediately close to the transform target portion 92 of the plate 9 regardless of the shape of the plate 9 during processing. With this, the transform target portion 92 can be appropriately heated.

Both the front-side heater 5 and the rear-side heater 4 are not necessarily required to be adopted, and any one of the front-side heater 5 and the rear-side heater 4 may be adopted. In this case, the relay boxes and the relay pipes may be omitted, and the lead portions (52, 53 or 42, 42) of the electric conducting pipe (51 or 41) may be directly connected to the connection boxes 61 and 62 of the heat station 6, respectively. However, when both the front-side heater 5 and the rear-side heater 4 are adopted as in Embodiments 1 and 2, the plate 9 can be heated from both sides of the plate in the thickness direction, and this can improve the formability.

When adopting a configuration in which each of the cooling liquid and the current flows through the electric conducting pipe 51 of the front-side heater 5 and the electric conducting pipe 41 of the rear-side heater 4 in parallel, the connection boxes 61 and 62 may be used as a header and an electric distributor in such a manner that: the relay boxes and the relay pipes are omitted; and the electric conducting pipe 51 of the front-side heater 5 and the electric conducting pipe 41 of the rear-side heater 4 are directly connected to the connection boxes 61 and 62, respectively. In this case, the electrically-conductive member 7 is unnecessary.

The electrically-conductive member 7 is not necessarily required to be hollow. For example, the electrically-conductive member 7 may be a metal plate. In this case, although not shown, a cooling pipe extending along the electrically-conductive member 7 while contacting the electrically-conductive member 7 may be provided. The upstream tube 6*e* may introduce the cooling liquid from the front-side second relay box 72 or the rear-side first relay box 75 to the cooling pipe, and the downstream tube 6*f* may introduce the cooling liquid from the cooling pipe to the rear-side second relay box 76 or the front-side first relay box 71. According to this configuration, the electrically-conductive member 7 can also be cooled by utilizing the cooling liquid having cooled the electric conducting pipe 51 of the front-side heater 5 or the electric conducting pipe 41 of the rear-side heater 4.

When the cooling liquid flows through the hollow electrically-conductive member 7 or the cooling pipe extending along the electrically-conductive member 7, both the first sub pipe 6*c* and the second sub pipe 6*d* may be constituted by a single tube, and branch pipes branching from the supply pipe 81 and the recovery pipe 82 may be connected to the electrically-conductive member 7 or the cooling pipe.

The heat station 6 is not necessarily required to include the pair of connection boxes 61 and 62. Instead of the connection boxes 61 and 62, a pair of terminals may be provided on a side surface of the main body 60. In this case, instead of the relay pipes 6*a* and 6*b*, the front-side first relay box 71 may be connected with one of the terminals through a cable, and the rear-side second relay box 76 may be connected with the other terminal through a cable. The circulating device 8 may supply the cooling liquid to the front-side first relay box 71 and recover the cooling liquid from the rear-side second relay box 76. However, when the heat station 6 includes the pair of connection boxes 61 and 62 communicating with the electric conducting pipe of the heater as in Embodiments 1 and 2, both an electric power line and a cooling liquid line are formed by connecting the pair of connection boxes 61 and 62 of the heat station 6 with the electric conducting pipes. With this, a simple configuration can be realized.

In the case of heating the transform target portion 92 of the plate 9 to a high temperature of not less than 700° C., each of the temperatures of the cores 57 and 58 of the front-side heater 5 and/or the cores 47 and 48 of the rear-side heater 4 may exceed a Curie point (temperature at which a magnetic property is lost) by heat radiation from the plate 9. The case of heating the transform target portion 92 to the high temperature is a case where the plate 9 is made of a titanium alloy, steel, stainless steel, a Ni alloy, a copper alloy, or the like. From this point of view, it is desirable that the configurations of the front-side heater 5 and/or the rear-side heater 4 shown in FIGS. 9 to 12 be adopted. Although FIGS. 9 to 12 show the rear-side heaters 4 of Modified Examples 1 to 4, each of the configurations shown in FIGS. 9 to 12 is applicable to the front-side heater 5.

Figure 9:
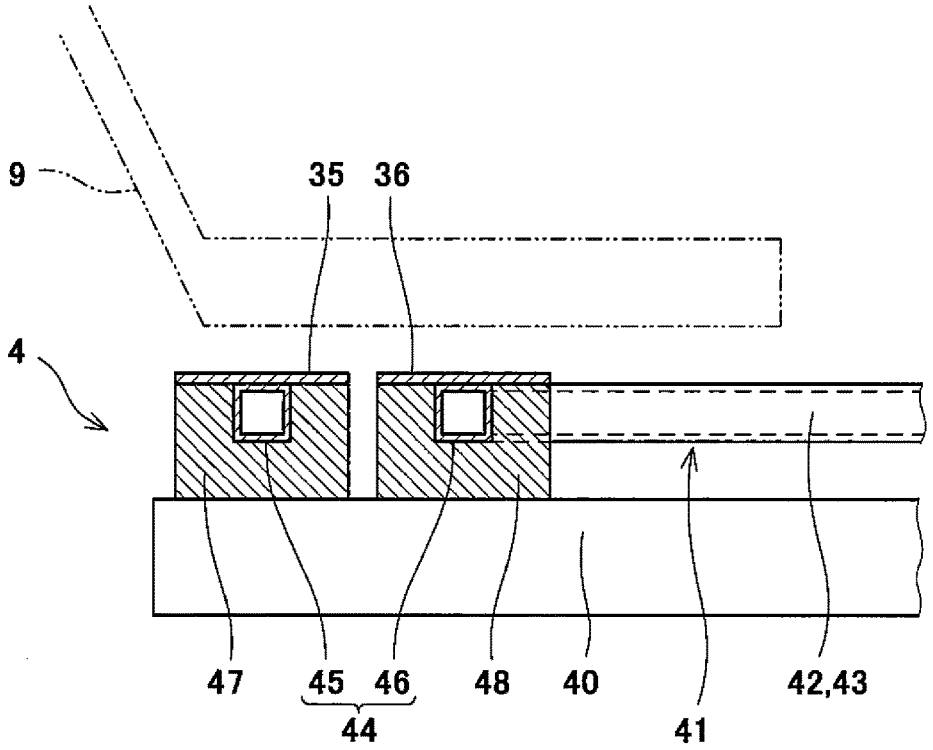
FIG. 9 is a cross-sectional side view showing a part of the rear-side heater of Modified Example 1.

In the rear-side heater 4 of Modified Example 1 shown in FIG. 9, an inner heat shielding layer 35 is formed on the first core 47, and outer heat shielding layers 36 are formed on the respective second cores 48. The inner heat shielding layer 35 is a thin, flat layer and covers a top surface of the inner circular-arc portion 45 and the top surfaces of the first core 47. Similarly, the outer heat shielding layer 36 is a thin, flat layer and covers a top surface of the outer circular-arc portion 46 and the top surfaces of the second core 48. According to this configuration, the heat radiation applied to the coil portion and the cores from the plate can be reduced.

The inner heat shielding layer 35 and the outer heat shielding layer 36 may be made of any material as long as the material has an insulation property and heat resistance. For example, each of the inner heat shielding layer 35 and the outer heat shielding layer 36 may be a coating film formed by curing a heat-shielding coating material or a plate made of a ceramics-based heat-resistant material.

Figure 10:
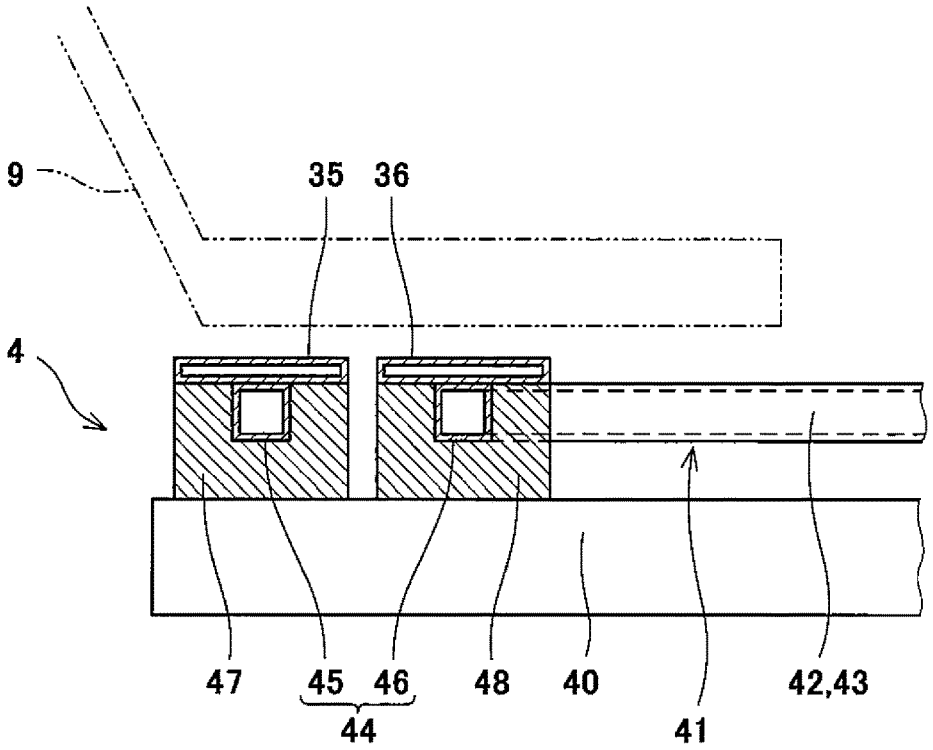
FIG. 10 is a cross-sectional side view showing a part of the rear-side heater of Modified Example 2.

In the rear-side heater 4 of Modified Example 2 shown in FIG. 10, a flat cooling pipe is used as each of the inner heat shielding layer 35 and the outer heat shielding layer 36. According to this configuration, the same effects as FIG. 9 can be obtained, and the first core 47 and the second cores 48 can be cooled actively. A heat medium for cooling flows through the cooling pipe independently from the electric conducting pipe 41. For example, the cooling liquid is supplied to the cooling pipe from the tank 83 (see FIG. 6) through a route that is different from the supply pipe 81 (see FIG. 6). Or, the heat medium flowing through the cooling pipe may be different from the heat medium flowing through the electric conducting pipe 41. The cooling pipe is made of, for example, a ceramics-based heat-resistant material.

Figure 11:
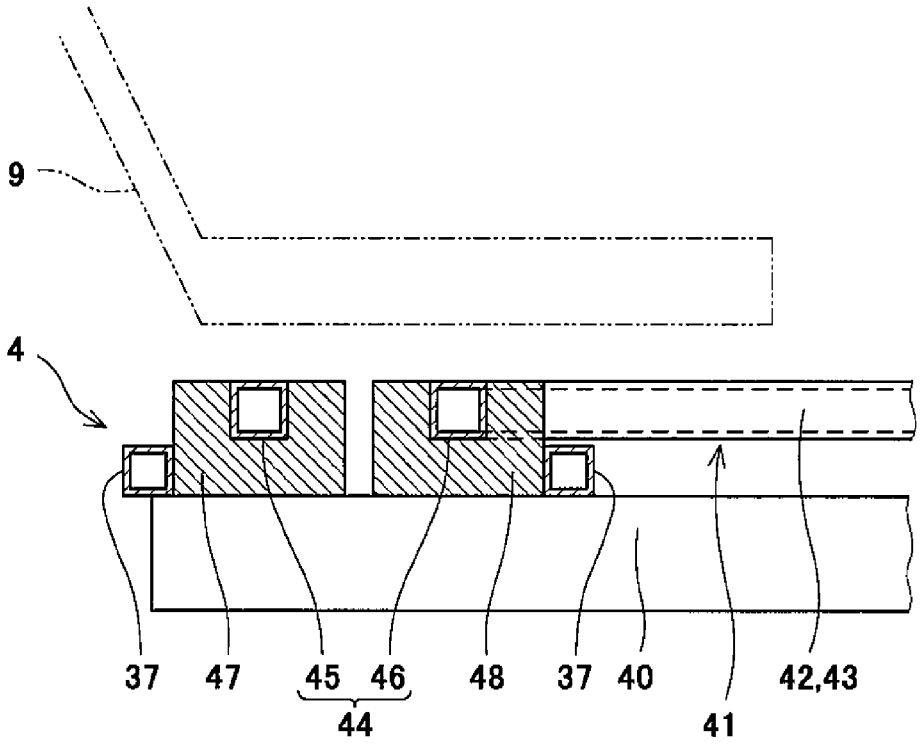
FIG. 11 is a cross-sectional side view showing a part of the rear-side heater of Modified Example 3.

In the rear-side heater 4 of Modified Example 3 shown in FIG. 11, cooling pipes 37 are provided so as to tightly contact an inner curved surface of the first core 47 and outer curved surfaces of the second cores 48, respectively. According to this configuration, the first core 47 and the second cores 48 can be cooled actively. A heat medium for cooling flows through the cooling pipe 37 independently from the electric conducting pipe 41. The cooling pipe 37 may be made of any material as long as the material has an insulation property and heat resistance. For example, the cooling pipe 37 is made of a ceramics-based heat-resistant material.

Figure 12:
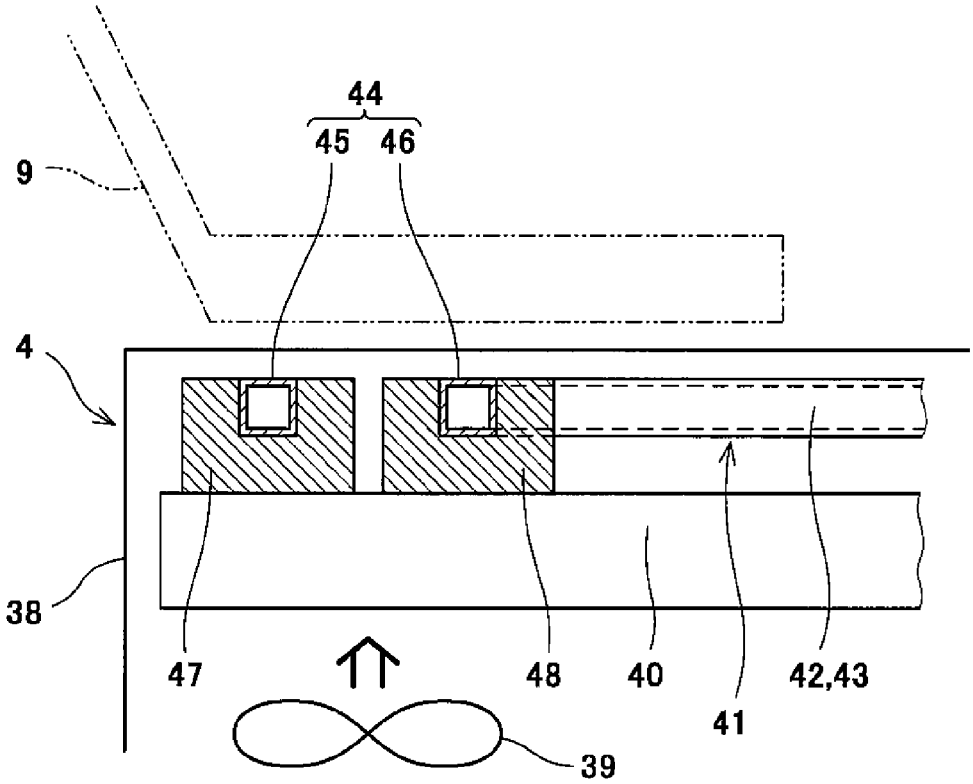
FIG. 12 is a cross-sectional side view showing a part of the rear-side heater of Modified Example 4.
Figure 13:
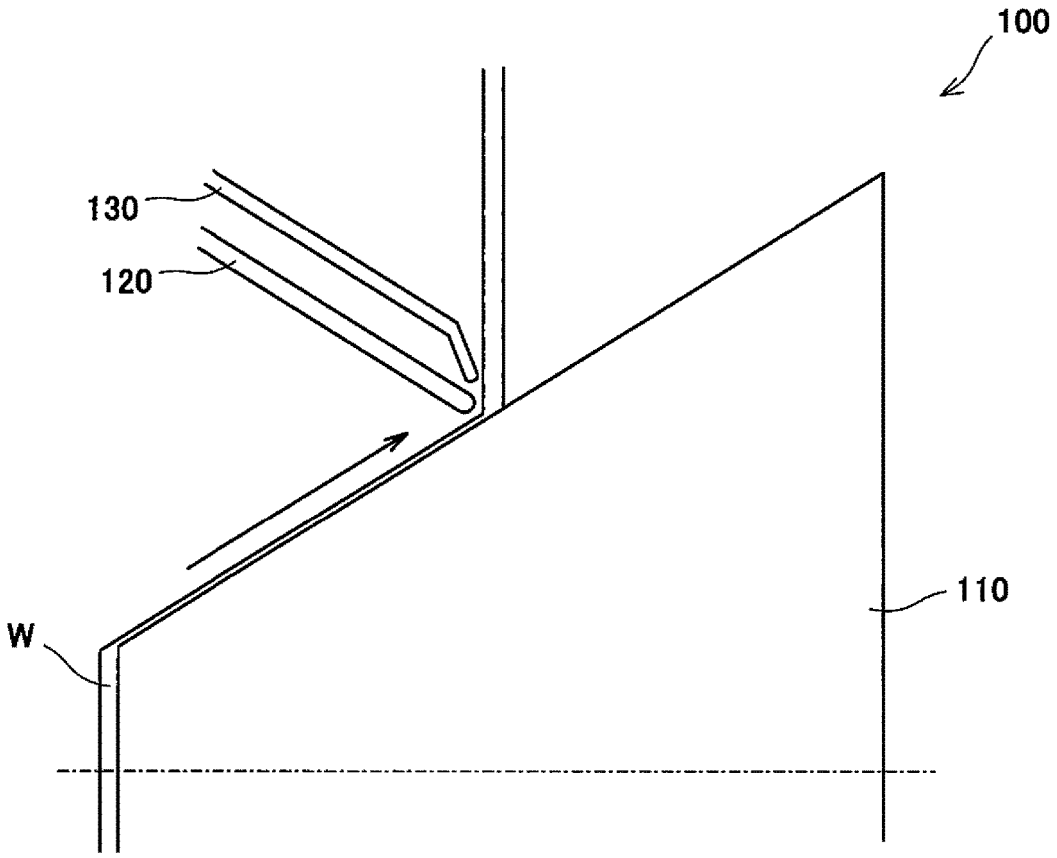
Fig. 13 PRIOR ART
FIG. 13 is a schematic configuration diagram showing a conventional spinning forming device.

A cover 38 surrounding the rear-side heater 4 is provided at the rear-side heater 4 of Modified Example 4 shown in FIG. 12. A fan 39 that sends air toward the first core 47 and the second cores 48 is disposed in the cover 38. According to this configuration, the first core 47, the second cores 48, and the coil portion 44 can be cooled without cooling the plate 9. The cover 38 may be made of any material as long as the material has an insulation property and heat resistance. For example, the cover 38 is made of a ceramics-based heat-resistant material.

Needless to say, the configuration shown in FIG. 9 or 10 can be combined with the configuration shown in FIG. 11 and/or FIG. 12.

INDUSTRIAL APPLICABILITY

The present invention is useful when performing spinning forming of plates made of various materials.

REFERENCE SIGNS LIST

1A, 1B spinning forming device
10 processing tool
21 rotating shaft
22 receiving jig
35 inner heat shielding layer
36 outer heat shielding layer
4 rear-side heater
5 front-side heater
41, 51 electric conducting pipe
42, 43, 52, 53 lead portion
44, 54 coil portion
47, 57 first core
48, 58 second core
6 heat station
61, 62 connection box
6*a* first relay pipe
6*b* second relay pipe
6*c* first sub pipe
6*d* second sub pipe
6*e* upstream tube
6*f* downstream tube
71 front-side first relay box
72 front-side second relay box
75 rear-side first relay box
76 rear-side second relay box
8 circulating device
9 plate
92 transform target portion

The invention claimed is:

1. A spinning forming device comprising:

a rotating shaft that rotates a plate to be formed;

a processing tool that presses a transform target portion of the plate to transform the plate, wherein the processing tool comprises one of a roller and a spatula;

a heater that locally heats the transform target portion by induction heating and includes an electric conducting pipe, the electric conducting pipe including two lead portions and a coil portion, the coil portion forming a single loop extending in a circumferential direction of the rotating shaft and having a doubled circular-arc shape facing a first side of the plate; the two lead portions extending in a radial direction of the rotating shaft in a plane on the first side of the plate, and the two lead portions each being electrically connected to a different end of the single loop formed by the coil portion, and a circulating device that circulates a cooling liquid through the electric conducting pipe, wherein the circulating device comprises a pump.

2. The spinning forming device according to claim 1, further comprising a heat station including a pair of connection boxes electrically connected to the electric conducting pipe and communicating with the electric conducting pipe, wherein the circulating device supplies the cooling liquid to one of the pair of connection boxes and recovers the cooling liquid from the other of the pair of connection boxes to circulate the cooling liquid through the electric conducting pipe.

3. The spinning forming device according to claim 2, wherein the heater includes:

a rear-side heater disposed at an opposite side of the processing tool across the plate; and a front-side heater disposed at a same side as the processing tool relative to the plate.

4. The spinning forming device according to claim 1, further comprising a receiving jig attached to the rotating shaft and supporting a central portion of the plate.

5. The spinning forming device according to claim 1, wherein the heater includes:

a first core covering an inner circular-arc portion of the coil portion from an opposite side of the plate;

a second core covering an outer circular-arc portion of the coil portion from the opposite side of the plate;

an inner heat shielding layer covering the inner circular-arc portion of the coil portion and the first core; and an outer heat shielding layer covering the outer circular-arc portion of the coil portion and the second core.

6. The spinning forming device according to claim 1, wherein the coil portion comprises:

an inner circular-arc portion having a first end and a second end;

a first outer circular-arc portion including a first end electrically connected to the first end of the inner circular arc portion and spaced apart from the inner circular arc portion in the radial direction of the rotating shaft; and a second outer circular-arc portion including a first end electrically connected to the first end of the inner circular-arc portion and spaced apart from the inner circular arc portion in the radial direction of the rotating shaft.

7. The spinning forming device according to claim 6, wherein the first outer circular-arc portion includes a second end opposite its first end, the second outer circular-arc portion includes a second end opposite its first end, and first outer circular-arc portion second end and the second outer circular-arc portion second end are spaced apart from each other in the circumferential direction of the rotating shaft.

8. The spinning forming device according to claim 1, wherein the electric conducting pipe is a first electric conducting pipe, the heater includes a second electric conducting pipe electrically connected in series with the first electric conducting pipe, the second electric conducting pipe including a second coil portion, the second coil portion of the second electric conducting pipe forming a second single loop extending in the circumferential direction of the rotating shaft and having a doubled circular-arc shape facing a second side of the plate opposite the first side of the plate, and the circulating device circulates the cooling liquid through the first and second electric conducting pipes in parallel.

9. A spinning forming device comprising:

a rotating shaft that rotates a plate to be formed;

a processing tool that presses a transform target portion of the plate to transform the plate;

a rear-side heater that locally heats the transform target portion by induction heating and includes an electric conducting pipe, the electric conducting pipe including a coil portion, the coil portion extending in a circumferential direction of the rotating shaft and having a doubled circular-arc shape facing the plate, the rear-side heater being disposed at an opposite side of the processing tool across the plate;

a front-side heater that locally heats the transform target portion by induction heating and includes an electric conducting pipe, the electric conducting pipe including a coil portion, the coil portion extending in the circumferential direction of the rotating shaft and having a doubled circular-arc shape facing the plate, the front-side heater being disposed at a same side as the processing tool relative to the plate;

a heat station including a pair of connection boxes electrically connected to the electric conducting pipe of the rear-side heater and the electric conducting pipe of the front-side heater and communicating with the electric conducting pipe of the rear-side heater and the electric conducting pipe of the front-side heater; and a circulating device that supplies a cooling liquid to one of the pair of connection boxes and recovers the cooling liquid from the other of the pair of connection boxes to circulate the cooling liquid through the electric conducting pipe of the rear-side heater and the electric conducting pipe of the front-side heater, wherein the heat station is configured such that: a current flows through the electric conducting pipe of the front-side heater and the electric conducting pipe of the rear-side heater in series; and the cooling liquid flows through the electric conducting pipe of the front-side heater and the electric conducting pipe of the rear-side heater in parallel.

10. The spinning forming device according to claim 9, wherein:

each of the electric conducting pipe of the front-side heater and the electric conducting pipe of the rear-side heater includes a pair of lead portions extending from the coil portion outward in a radial direction of the rotating shaft; and the heat station includes a front-side first relay box and a front-side second relay box connected to the respective lead portions of the front-side heater, an electrically-conductive first relay pipe through which the front-side first relay box and one of the pair of connection boxes communicate with each other, a rear-side first relay box and a rear-side second relay box connected to the respective lead portions of the rear-side heater, an electrically-conductive second relay pipe through which the rear-side second relay box and the other connection box communicate with each other, an insulating first sub pipe through which the front-side first relay box and the rear-side first relay box communicate with each other, an insulating second sub pipe through which the front-side second relay box and the rear-side second relay box communicate with each other, and an electrically-conductive member through which the front-side second relay box and the rear-side first relay box are electrically connected to each other.

11. The spinning forming device according to claim 10, wherein:

the electrically-conductive member is a hollow member in which the cooling liquid flows; and one of the first sub pipe and the second sub pipe includes an upstream tube through which the cooling liquid having flowed through the electric conducting pipe of the front-side heater or the rear-side heater is introduced from the front-side second relay box or the rear-side first relay box to the electrically-conductive member, and a downstream tube through which the cooling liquid is introduced from the electrically-conductive member to the rear-side second relay box or the front-side first relay box.

12. The spinning forming device according to claim 10, further comprising a cooling pipe extending along the electrically-conductive member while contacting the electrically-conductive member, wherein one of the first sub pipe and the second sub pipe includes an upstream tube through which the cooling liquid having flowed through the electric conducting pipe of the front-side heater or the rear-side heater is introduced from the front-side second relay box or the rear-side first relay box to the cooling pipe, and a downstream tube through which the cooling liquid is introduced from the cooling pipe to the rear-side second relay box or the front-side first relay box.

* * * * *